US007122744B2

(12) United States Patent
Walter et al.

(10) Patent No.: US 7,122,744 B2
(45) Date of Patent: Oct. 17, 2006

(54) PROFILED RAIL AND ACCESSORIES USED AS A SUSPENSION DEVICE

(75) Inventors: Herbert Walter, Müllheim (DE); Manfred Uecker, Rheinfelden (DE)

(73) Assignee: Visplay International AG, Muttenz (CH)

( * ) Notice: Subject to any disclaimer, the term of this patent is extended or adjusted under 35 U.S.C. 154(b) by 0 days.

(21) Appl. No.: 10/505,389

(22) PCT Filed: Feb. 24, 2003

(86) PCT No.: PCT/CH03/00139

§ 371 (c)(1),
(2), (4) Date: Aug. 20, 2004

(87) PCT Pub. No.: WO03/070060

PCT Pub. Date: Aug. 28, 2003

(65) Prior Publication Data

US 2005/0082082 A1 Apr. 21, 2005

(30) Foreign Application Priority Data

Feb. 23, 2002 (DE) ..... 102 07 715

(51) Int. Cl.
*H01B 1/00* (2006.01)

(52) U.S. Cl. ..... 174/163 R; 174/161 R; 439/110

(58) Field of Classification Search ..... 174/163 R, 174/161 R, 70 B, 68.1; 439/110, 117
See application file for complete search history.

(56) References Cited

U.S. PATENT DOCUMENTS 3,753,209 A 8/1973 Hesse
4,812,134 A 3/1989 Miller et al.
4,817,538 A 4/1989 Michaelsen
4,919,625 A * 4/1990 Coutre ..... 439/118
5,485,933 A 1/1996 Crooymans
5,869,786 A * 2/1999 Jaakkola et al. ..... 174/96
6,176,711 B1 * 1/2001 Rohr et al. ..... 439/110
6,631,813 B1 10/2003 Walter et al.

FOREIGN PATENT DOCUMENTS

| | | |
|---|---|---|
| DE | 299 03 019 U1 | 6/1999 |
| EP | 0 007 071 A1 | 1/1980 |
| GB | 2 224 923 A | 5/1990 |
| WO | WO 01/43599 A1 | 6/2001 |

* cited by examiner

*Primary Examiner*—Jinhee Lee
(74) *Attorney, Agent, or Firm*—McCarter & English, LLP

(57) ABSTRACT

The profiled rail (1) is designed for a suspension device having carriers (6) which can be plugged into the profiled rail (1) and on which articles can be suspended or set down. The profiled rail (1) is fastened horizontally on a carrying structure (9) and has a passage (10) which extends from a front entry point and into which the carriers (6) can be plugged. Arranged within the profiled rail (1) is a conductor rail (2) with current conductors (24,27) which is supplied with electricity via a power supply (3), the current conductors being accessible from the passage (10) for the purpose of tapping electricity for supplying a consuming unit (7) which can be connected via a feed line (46). The current conductors (24,27) can be tapped in an uninterrupted manner over their entire axial extent by means of an adapter (4) which can be pushed into the passage (10), can be positioned along the profiled rail (1) and can be connected and disconnected. The electrification of the profiled rail (1) gives rise to extended design possibilities for furniture, shop and trade-fair construction, and for outfitting systems, as a result of the integration of electric current.

8 Claims, 11 Drawing Sheets

PROFILED RAIL AND ACCESSORIES USED AS A SUSPENSION DEVICE

FIELD OF THE INVENTION

The invention relates to a profiled rail and accessories used as a suspension device having carriers of different types, for example supports, shelves or carrying arms, which can be fitted into the profiled rail. The articles which can be suspended or set down on the support may be, for example, displayed goods, items for commercial or private use, exhibits or decorative objects. The profiled rail is fastened horizontally on a carrying structure, essentially in the form of a rear wall or panel and rack components. The profiled rail can be utilized individually as a fitting; it is possible, for example, for a display wall in a commercial establishment to be fitted out with a plurality of such profiled rails.

BACKGROUND OF THE INVENTION

GB 2 224 923 discloses a horizontal rail with a plug-in slot which is widened downward behind the access point and has a horizontal base in the widened portion. An upwardly extending groove is formed in the vicinity of the bottom of the slot, and a narrowing bead is positioned in front of this groove. In front of the bead, the slot has a greater extent in the upward direction. Shelves or carrying arms can be inserted, as carriers, into the horizontal rail, a tongue element which is directed toward the plug-in slot being present on these shelves or carrying arms for the purpose of engaging in the slot. The tongue element has an upwardly directed nose at the front to complement the upwardly directed groove in the horizontal rail. At the front end, the tongue element has a bevel on its underside. When the shelf or the carrying arm is inserted, the front edge is raised, while the tongue element is lowered. The tongue element can thus be introduced into the slot, the bevel being in the vicinity of the bottom and the nose ending up located below the groove. Once the shelf or carrying arm has been positioned horizontally, the nose engages in the groove, with the result that a horizontal drawing-out action is not possible. At the access point, the tongue element is supported on the bottom edge of the slot. This horizontal rail has to be inserted into a rear carrier, e.g. a wooden beam, and additionally covered at the front with vertically attached panel elements. In this respect, the design involves high assembly outlay and is not particularly versatile.

WO 01/43599 discloses a suspension device having a horizontally fitted profiled rail with a passage which extends between a front entry point and a rear boundary. The passage has, at the top, a slope which slopes upward in the direction of the entry point and thus forms a top clearance. At the bottom, the passage has an inclination which is inclined downward in the direction of the boundary and thus forms a bottom clearance. The passage also has, at the top, an undercut which is positioned in front of the boundary, as seen in the direction of the entry point. The plug-in carrier has at least one tongue element which can be plugged into the passage of the profiled rail and has an upwardly directed hook which is intended for engaging in the undercut. As an alternative, the carrier is a shelf of which the rear border can be plugged into the passage of the profiled rail. This device has been successfully used for many years now, but there is a desire to extend it in functional terms.

OBJECT OF THE INVENTION

In view of the increased requirements, with the focus on functional diversity and originality of design, the object of the invention is to propose a profiled rail of the above-described type and also accessories which extend the possibilities for use as a result of electric current being supplied. The intention is for the electrical installation to be accommodated in as space-saving and unobtrusive a manner as possible and to be capable of advantageous installation and versatile use.

SUMMARY OF THE INVENTION

The present invention overcomes the disadvantages and shortcomings discussed above by providing a profiled rail designed for a suspension device having carriers which can be plugged into the profiled rail and on which articles can be suspended or set down. The profited rail is intended for fastening horizontally on a carrying structure and has a passage which extends into the profiled rail, in principle horizontally, from a front entry point. Arranged within the profiled rail is a conductor rail with current conductors which is supplied with electricity via a power supply. The current conductors are accessible from the passage for the purpose of tapping electricity for supplying a consuming unit which can be connected via a feed line.

The conductor rail comprises an insulating profile and current conductors which are accommodated in wire channels and can be tapped via access points substantially over the entire axial extent of the current conductors and in a substantially uninterrupted manner. The conductor rail is arranged in a current-conducting groove which extends from the passage. The insulating profile of the conductor rail has outer contours which fit into complementary inner contours of the current-conducting grooves. The current-conducting groove is arranged, remote from the entry point, in the depth of the passage and substantially perpendicularly to the latter. The access points open, substantially perpendicularly to the passage. The insulating profile has a substantially M-shaped cross section. The two access points are each located at the bottom within the side legs of the M-shaped cross section. The wire channels with the current conductors provided therein are each located at the top within the side legs, in the profile tips. The current conductors can be tapped by an adapter which can be pushed into the passage.

The end of the passage is defined by a base plate. The base plate has a top extension extending upward and a bottom extension extending downward, beyond the region of the incoming passage. Adjacent to the base plate, a hook groove extends upward, and an arresting groove extends downward, out of the passage. The passage is bounded at the top by a top strut and at the bottom by a bottom strut. At the top, the passage has a slope which slopes upward in the direction of the entry point and thus forms a top clearance. At the bottom, the passage has an inclination which is inclined downward in the direction of the base plate and thus forms a bottom clearance. In the bottom strut, in the vicinity of the entry point, a strip groove is provided for accommodating a non-slip and damping, preferably elastic extruded profile. Arranged at the end of the passage is an axially accessible raised molding, extending along the profiled rail, for tapping the ground contact of the adapter.

Furthermore, the profiled rail has a supporting strut which extends from the bottom strut, opens out into the bottom extension and encloses a cavity with the bottom strut. Located on the top strut is a downwardly extending tongue with a tongue groove located alongside it. Provided on the bottom strut is a downwardly extended tongue with a tongue groove located alongside it. In each case one screw-connection channel is provided in the region where the supporting strut extends from the bottom strut and in the region where the top strut opens out into the base plate. A notched line is provided as a marking preferably on both sides of the top extension. The tongue strips are intended for being accommodated in tongue grooves which are present in the edges of attached panels. The notched lines serve as an orientation means for screw holes which may optionally be provided, and can be utilized in order for the construction comprising the carrying structure with one or more profiled rails being introduced to be fastened directly or indirectly on a part of a building.

The power supply is formed, in the first instance, by a cutout on the profiled rail, into which a connection terminal is inserted. The power supply also includes a plug coupling comprising a bushing, which is positioned in the cutout alongside the connection terminal, and a plug, which can be coupled to the bushing from the outside and to which the current-supplying feed line is connected. Finally, the power supply includes a ground terminal on the profiled rail.

The carrier has, when in the form of a carrying arm, at the plug-in end of the bar part, at least one tongue element which can be plugged into the passage of the profiled rail and has a bottom tapered portion and an upwardly directed hook which is intended for engaging in the hook groove. As an alternative, the carrier is in the form of a shelf of which the rear edge can be plugged into the passage of the profiled rail. The adapter can be pushed separately into the passage for power take-off or, inserted into an aperture of a shelf, can be pushed into the passage together with the shelf.

The adapter has, in the first instance, a rotatable pin and, on the input side, contact lugs which can be pivoted on the rotatable pin and are intended for power take-off from the current conductors, and a tap for the grounding conductor. Located on the output side are line connections and a ground-contact connection, which are connected to a feed line to a consuming unit. The adapter further comprises a housing with a bottom plate, a cover, an output connector and an optional plate groove in the housing for insertion into the aperture of a shelf. The output connector merges into a conduit for further cable routing to the consumer. A rotary knob, which is accessible to the user and connected to the pin, is provided on the adapter. The housing contains a pin bearing, and an inhibitor acts on the pin. Seated on the pin is a catch which, in the connected state, when the contact lugs butt against the current conductors, engages at least in one of the grooves. In the disconnected state, the catch is disengaged, with the result that the adapter can be pushed into the passage or drawn out of the passage.

The adapter is provided, in particular, for use with the abovedescribed profiled rail, but constitutes a subject matter of the invention which is independent from this profiled rail.

BRIEF DESCRIPTION OF THE DRAWINGS

In the drawings:

FIG. 9 is a sectional view of the profiled rail according the FIG. 1A with a panel attached and a carrying arm plugged in.

EXEMPLARY EMBODIMENT

Figure 1A:
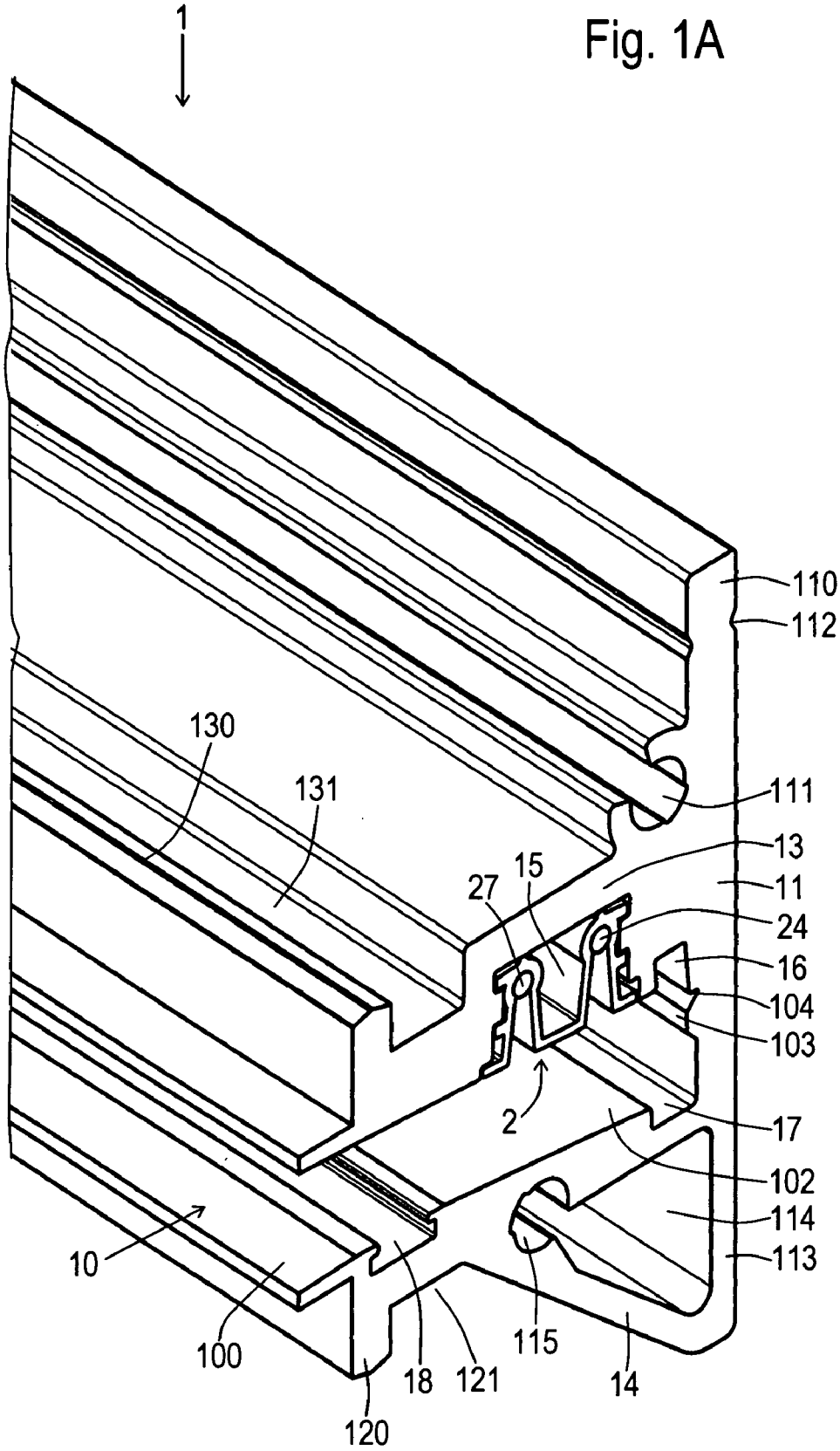
FIG. 1A is a perspective view of a profiled rail according to the present invention.
Figure 1B:
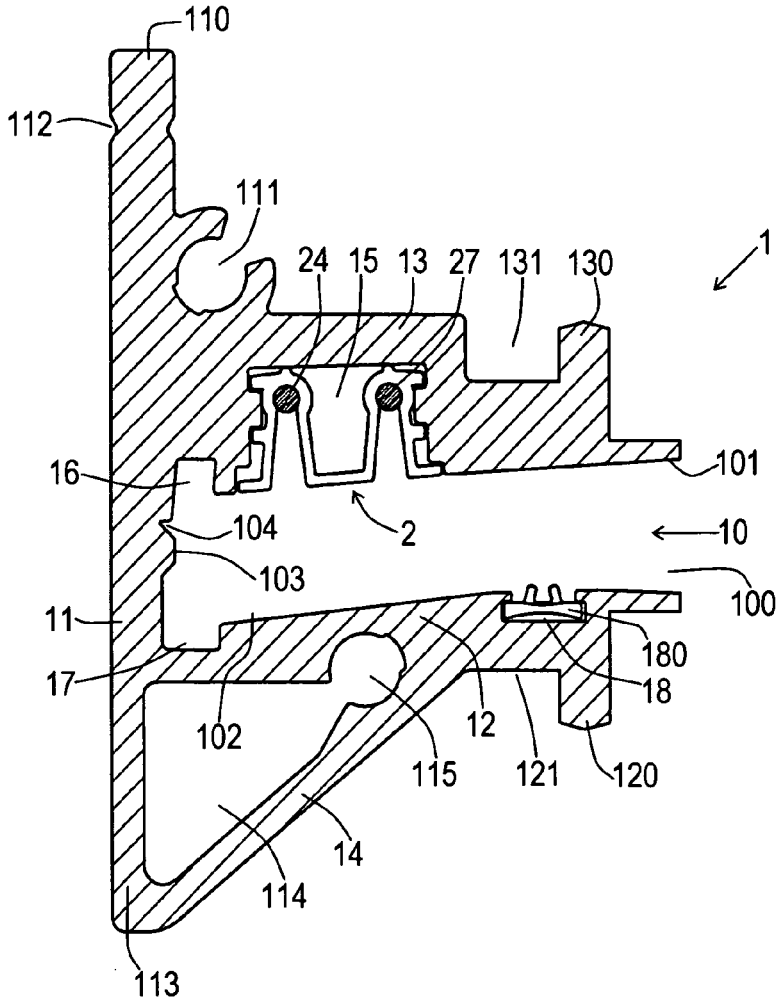
FIG. 1B is a side sectional view of the profiled rail according to FIG. 1A.
Figure 1D:
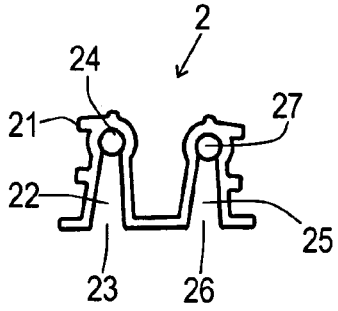
FIG. 1D is a cross-sectional view of the conductor rail according to FIG. 1C.
Figure 1C:
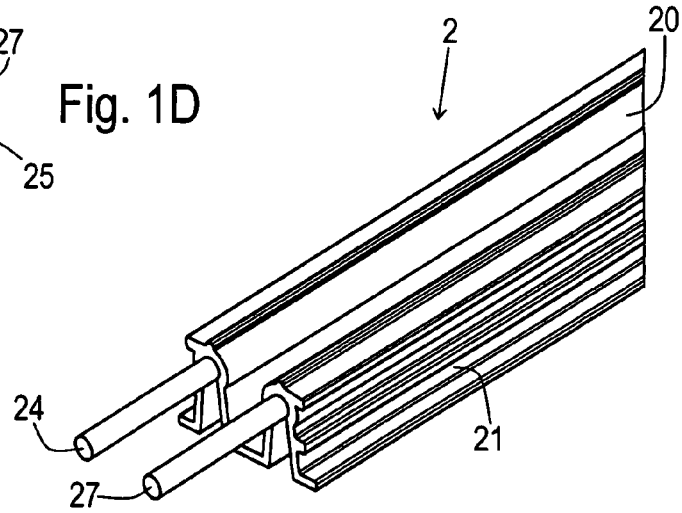
FIG. 1C is a perspective view of a separate conductor rail from the profiled rail according to FIG. 1A.
Figure 2A:
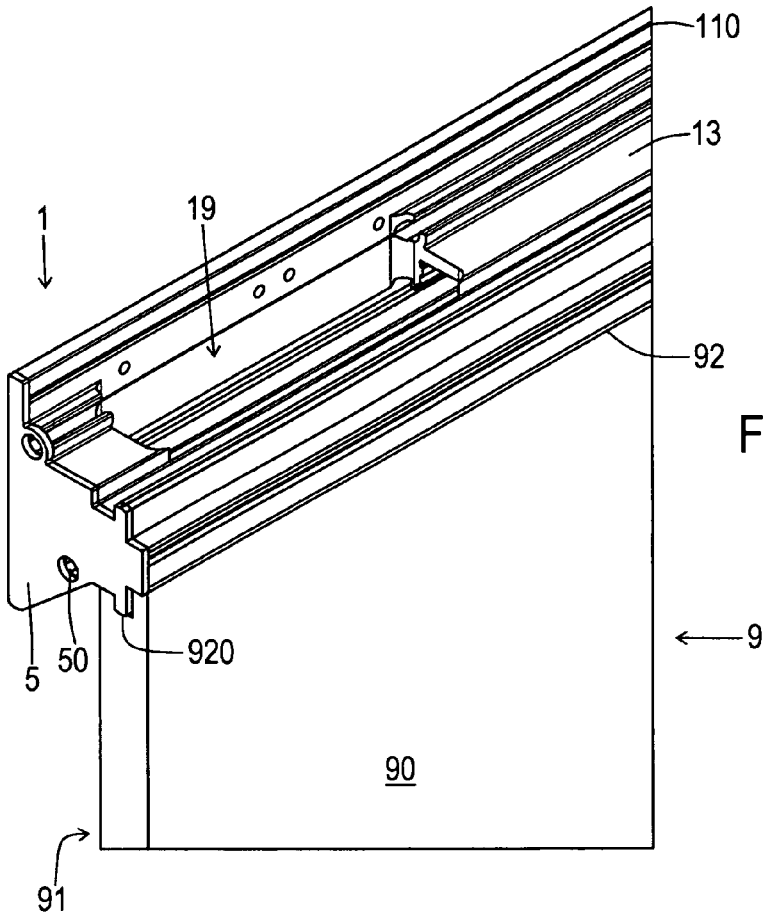
FIG. 2A is a perspective view of the profiled rail according to FIG. 1A with a cutout for the power supply and a panel attached.
Figure 2B:
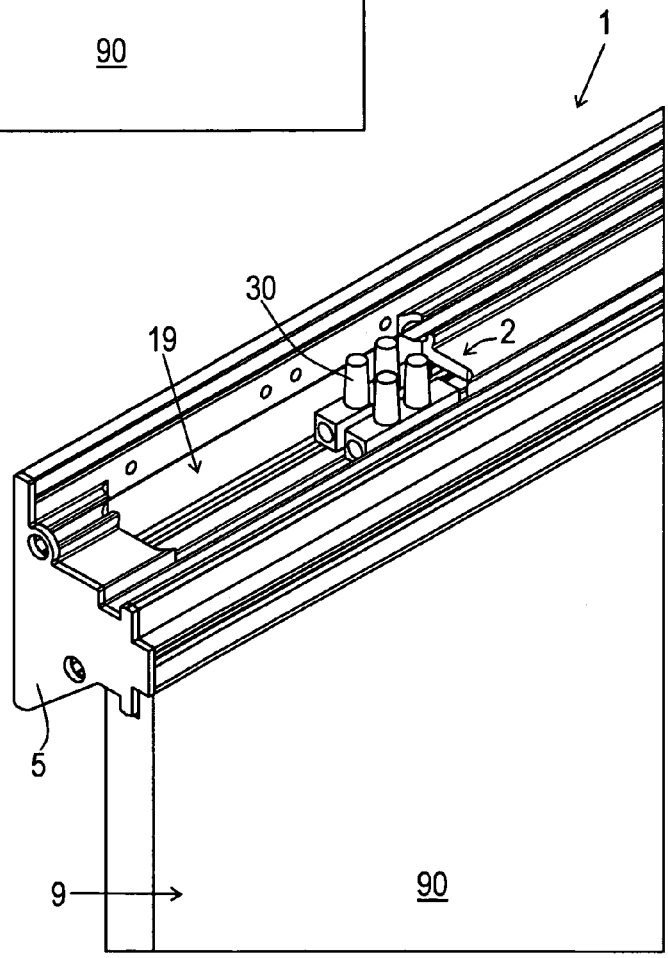
FIG. 2B is a view similar to FIG. 2A with a connection terminal inserted.
Figure 2C:
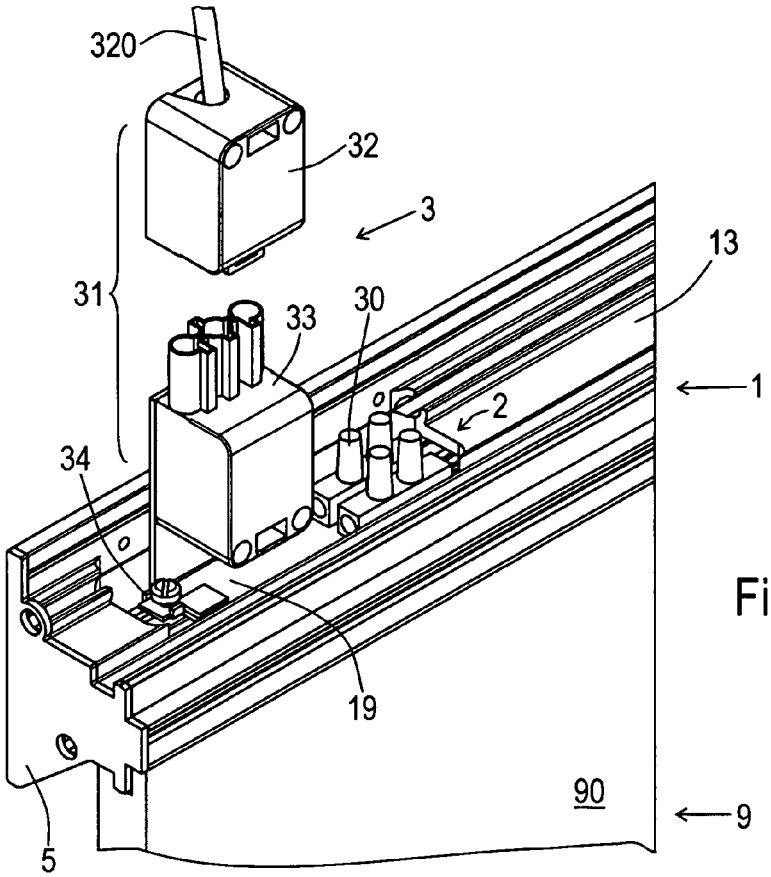
FIG. 2C is a view similar to FIG. 2B with a plug coupling shown exploded from the profiled rail.
Figure 2D:
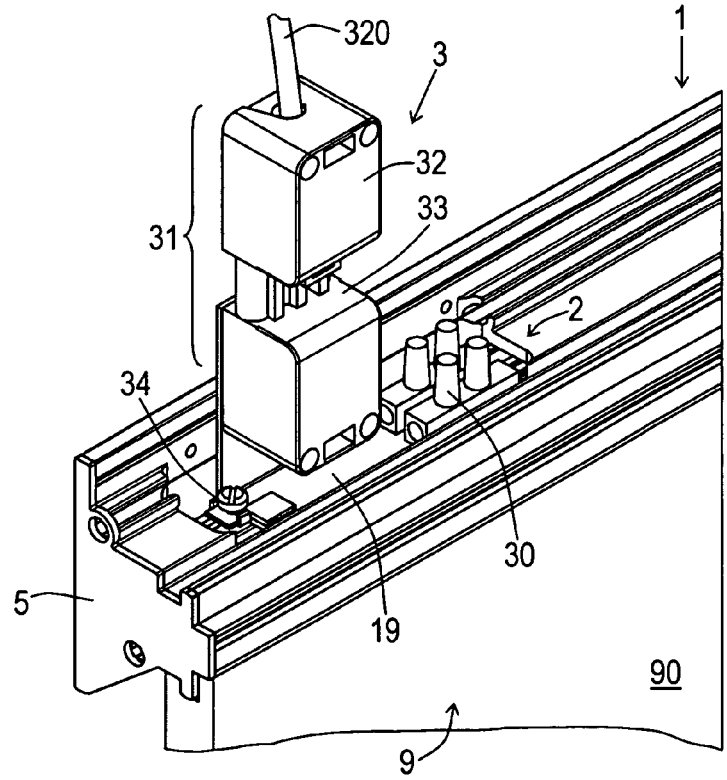
FIG. 2D is a view similar to FIG. 2C with the plug coupling connected.
Figure 3A:
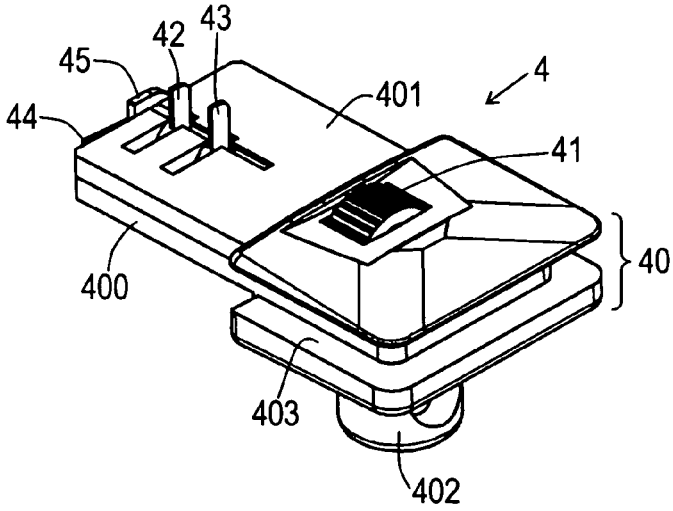
FIG. 3A is a perspective view of an adapter in the locked, connected position.
Figure 3B:
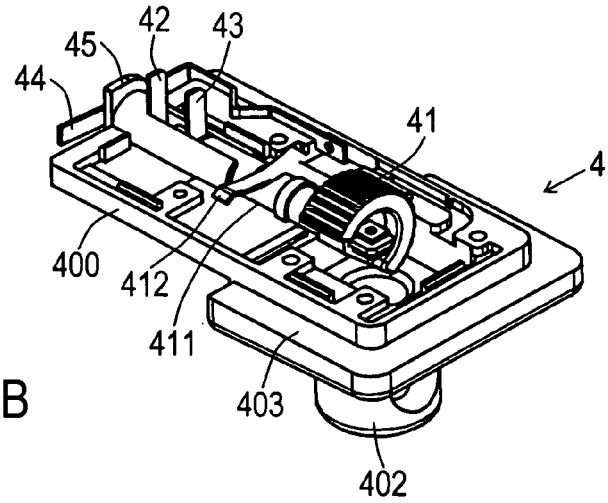
FIG. 3B is a view similar to FIG. 3A in which the adapter is shown without a cover.
Figure 3C:
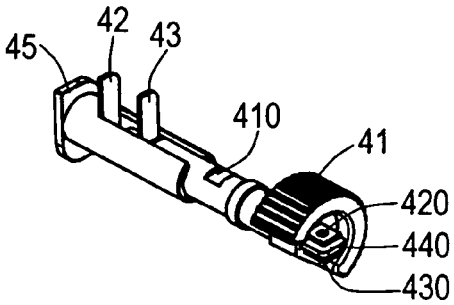
FIG. 3C is a partial view showing a separate rotary knob with pin and contacts according to FIG. 3B.
Figure 3D:
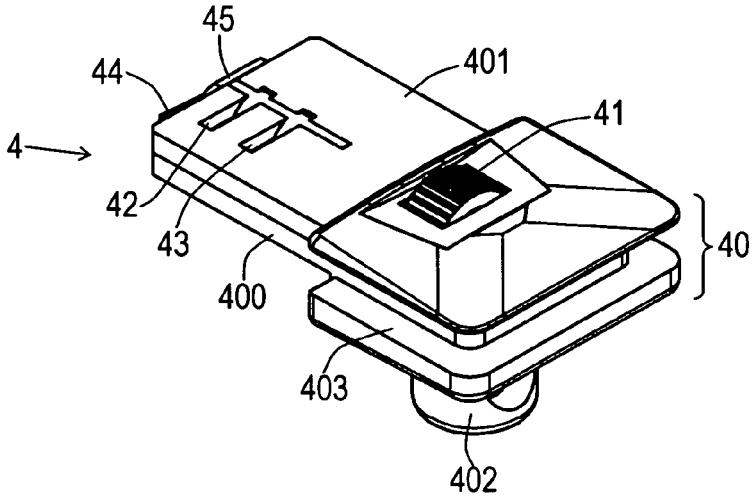
FIG. 3D is a perspective view of the adapter according to FIG. 3A in the unlocked, disconnected position.
Figure 3E:
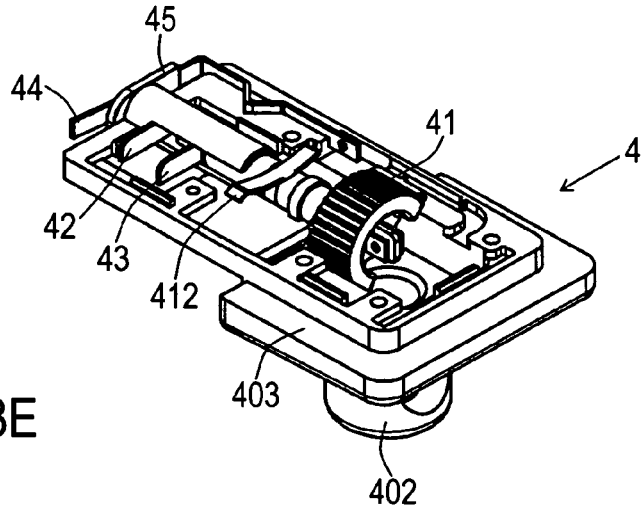
FIG. 3E is a view similar to FIG. 3D in which the adapter is shown without the cover.
Figure 3F:
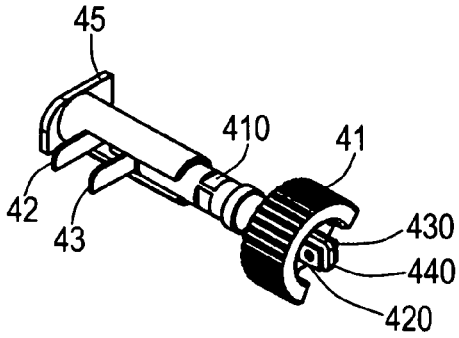
FIG. 3F is a partial view showing a separate rotary knob with pin and contacts from FIG. 3E.
Figure 4:
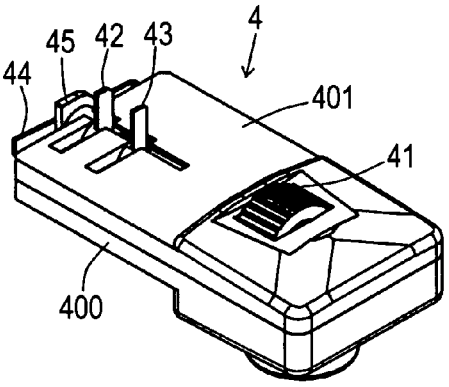
FIG. 4 is a perspective view of a modified adapter according to FIG. 3A in the locked, connected position, without a plate groove in the housing.
Figure 5B:
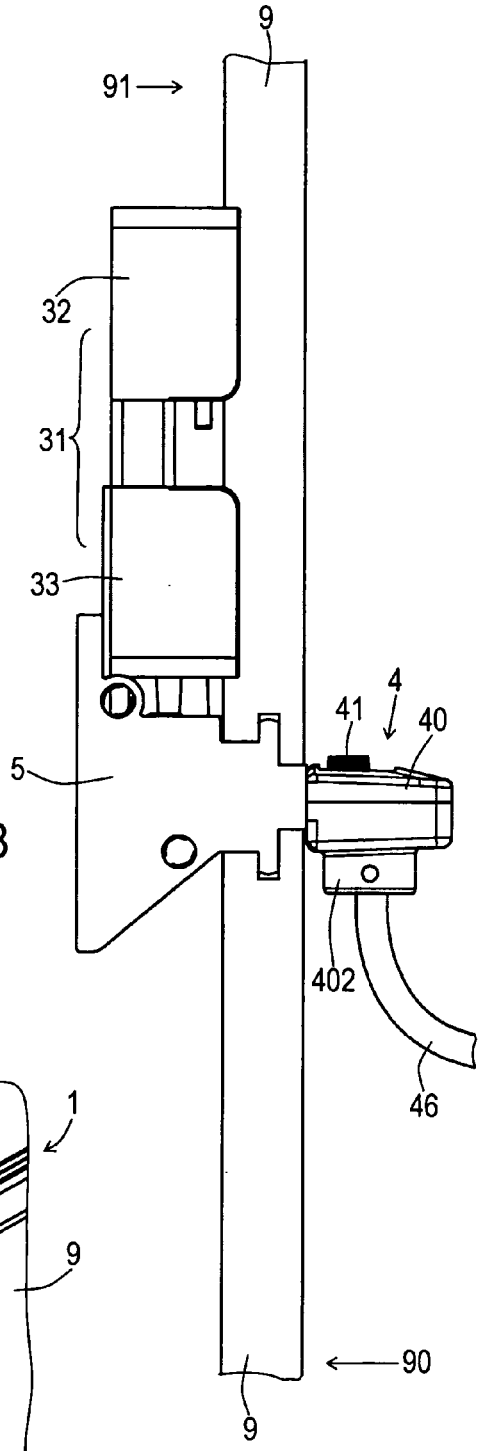
FIG. 5B is a right side view of the adapter and profiled rail assembly according to FIG. 5A.
Figure 5A:
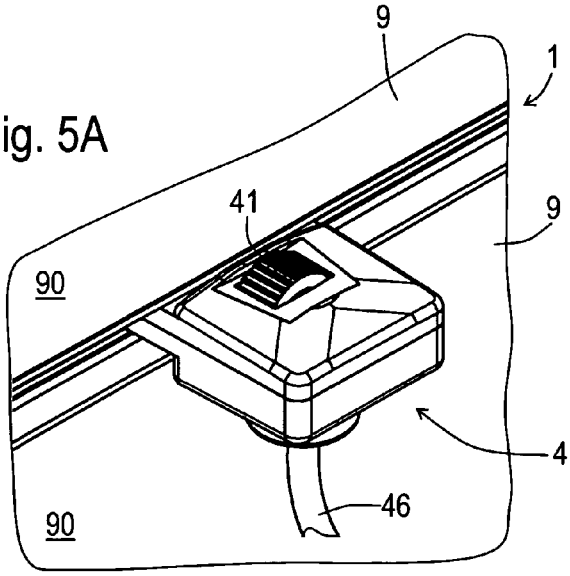
FIG. 5A is a partial perspective view of the adapter according to FIG. 4 inserted into the profiled rail according to FIG. IA, with a panel attached.
Figure 6A:
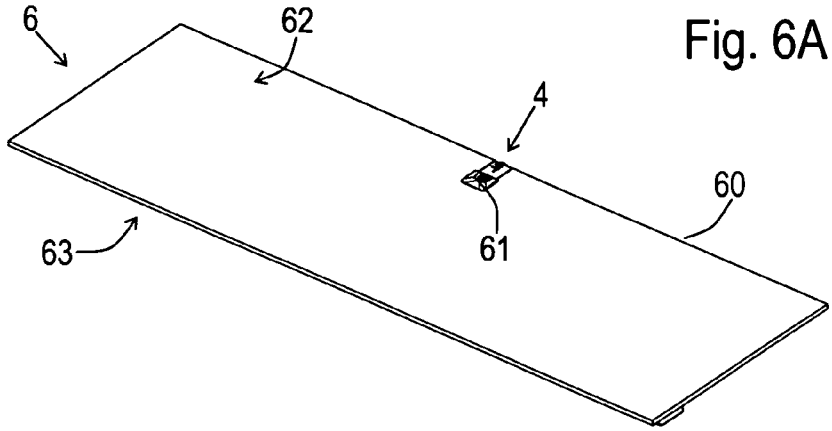
FIG. 6A is a top perspective view of the adapter according to FIG. 3A inserted into a shelf.
Figure 6B:
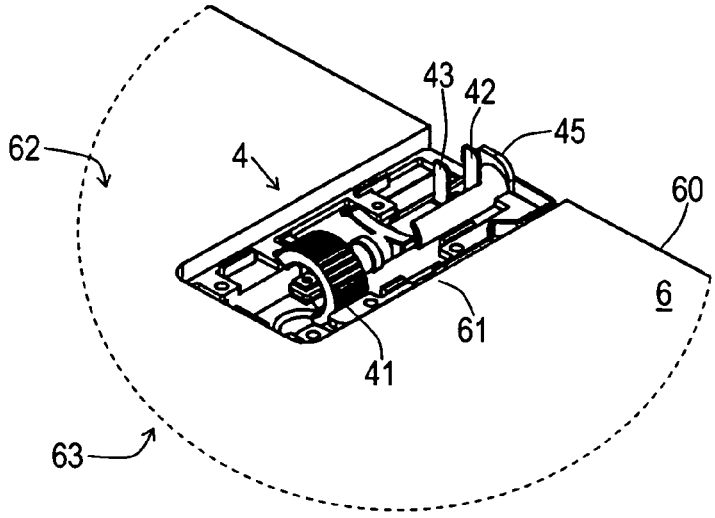
FIG. 6B is a detail, view of the adapter according to FIG. 6A, the adapter having no cover.
Figure 6C:
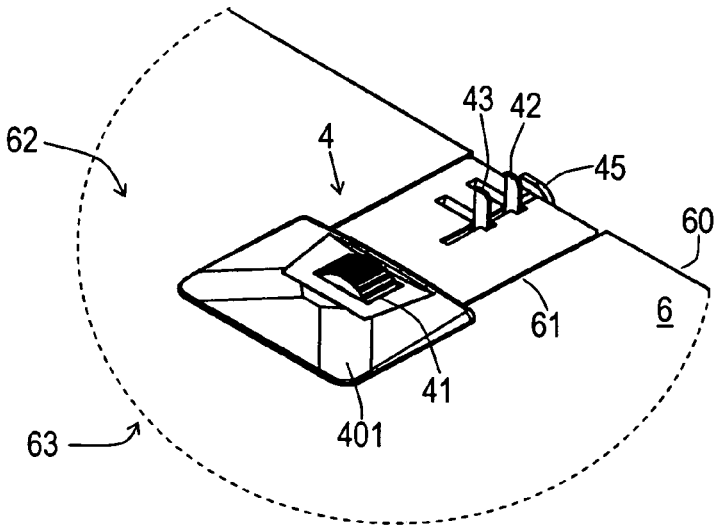
FIG. 6C is a detail view of the adapter according to FIG. 6B, the adapter having the cover attached.
Figure 7A:
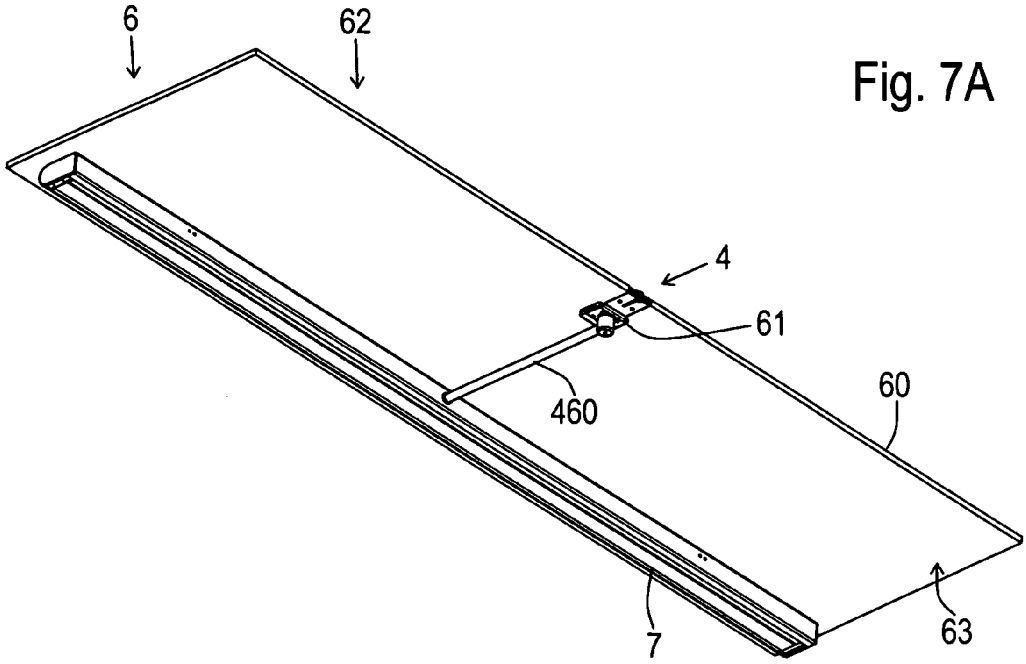
FIG. 7A is a bottom perspective view of the adapter and shelf according to FIG. 6A with a luminaire fitted beneath the shelf.
Figure 7B:
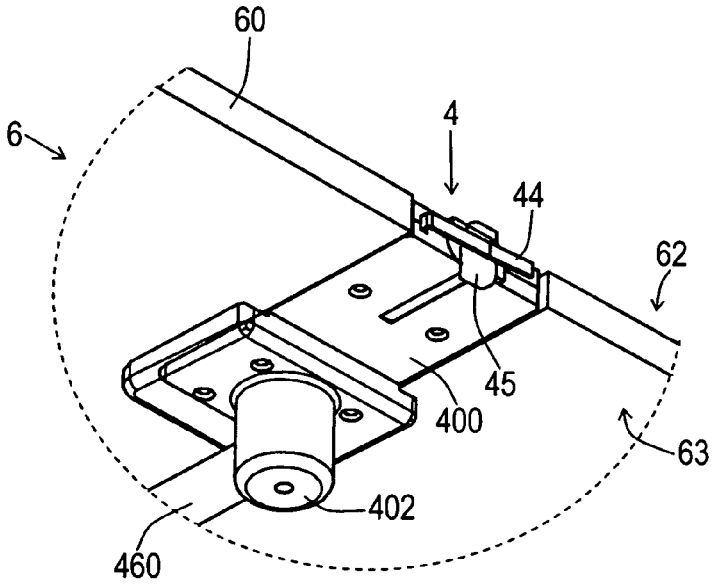
FIG. 7B is a detail view of the adapter and shelf according to FIG. 7A.
Figure 8A:
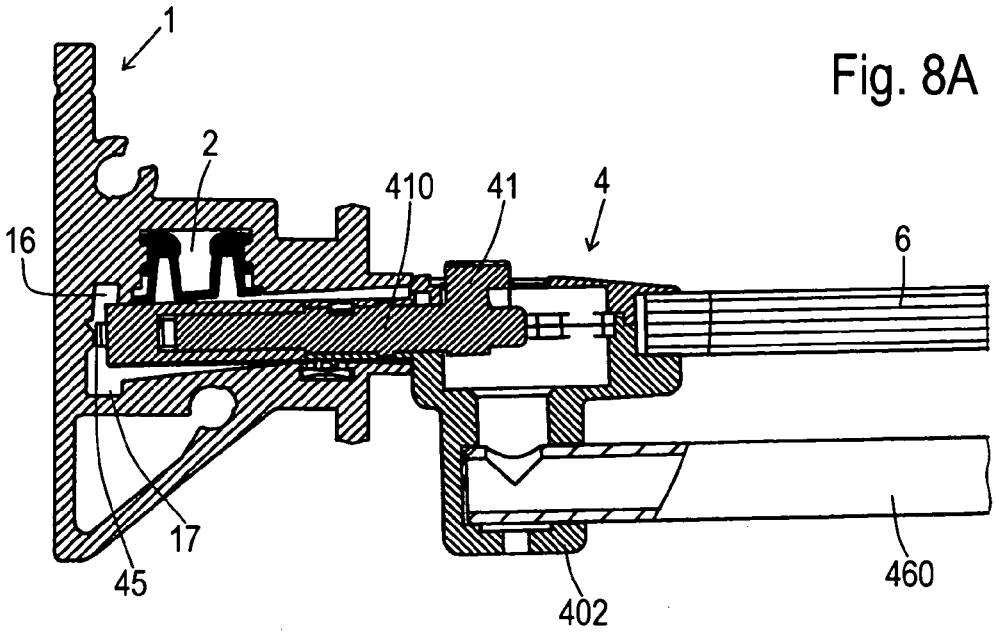
FIG. 8A is a sectional view of the shelf with the adapter according to FIG. 6A inserted into the profiled rail according to FIG. 1A and in the unlocked,disconnected position.
Figure 8B:
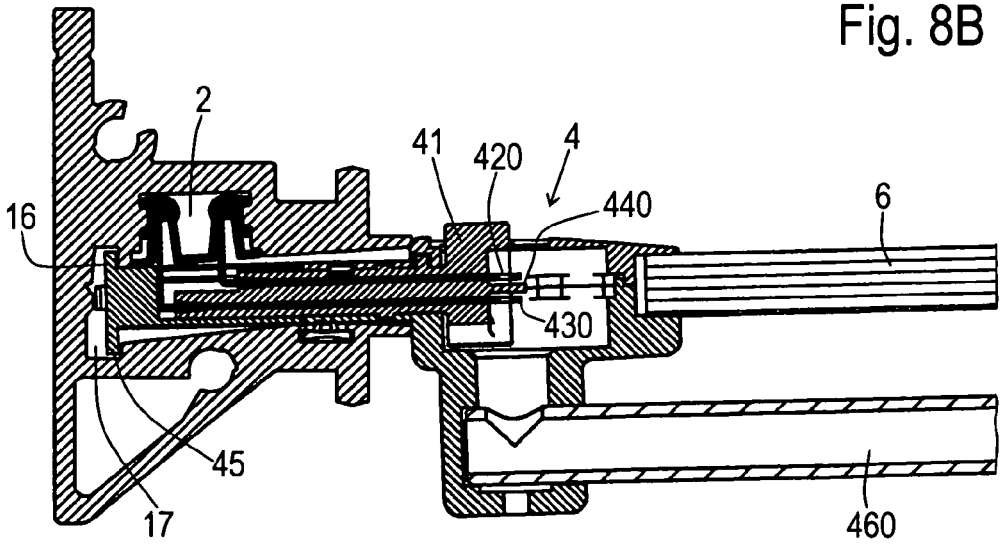
FIG. 8B is a view similar to FIG. 8A, with the adapter in the locked, connected position.
Figure 8C:
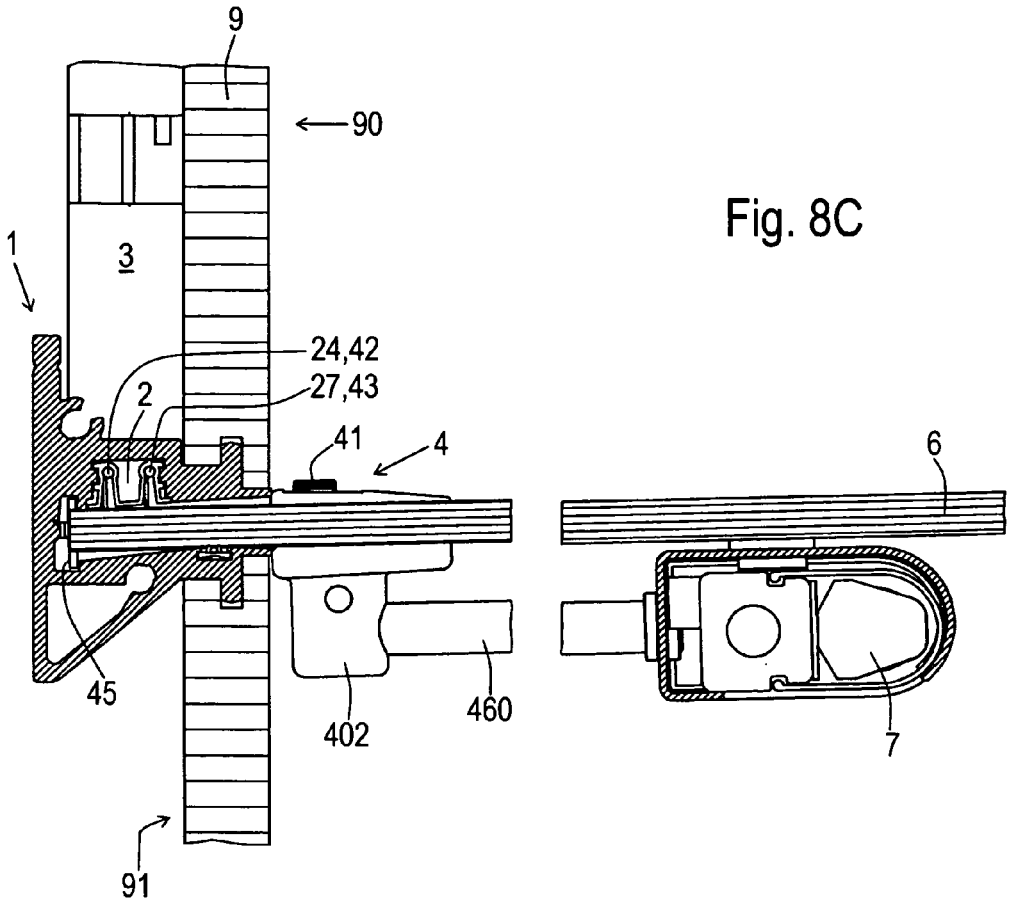
FIG. 8C is a view similar to FIG. 8B also showing the power supply, the luminaire and the panel attached.
Figure 9:
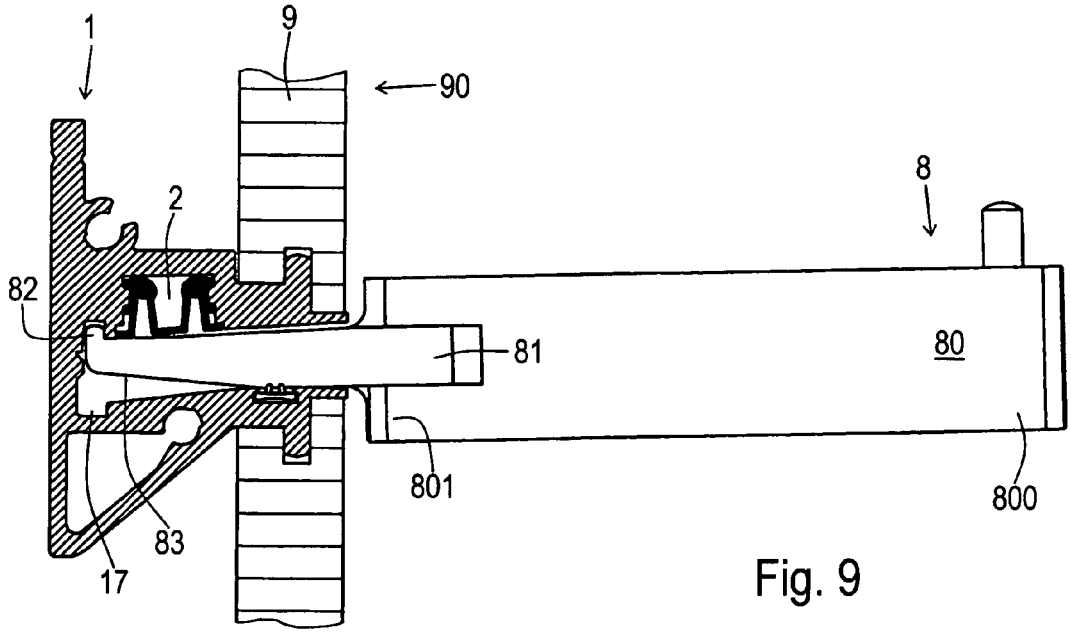

With reference to the attached drawings, the detailed description of an exemplary embodiment of the profiled rail according to the invention and the accessories used with the adapter will be given hereinbelow.

The following applies to the rest of the description. If, in order to avoid ambiguity in the drawings, a figure contains designations which are not explained in the directly associated text of the description, then you are referred to the point at which they are mentioned in previous or subsequent descriptions of the figures. For reasons of clarity, components are not usually designated again in further figures, provided that it is clear from the drawings that they are "recurring" components.

The profiled rail 1 is provided for a suspension device having carriers 6,8 which can be plugged into the profiled rail 1 and on which articles can be suspended or set down, the profiled rail 1 being intended for fastening horizontally on a carrying structure 9, by way of a passage 10 which extends into the profiled rail 1, in principle horizontally, from a front entry point 100. Arranged within the profiled rail 1 is a conductor rail 2 with current conductors 24,27 which is supplied with electricity via a power supply 3. The current conductors 24,27 are accessible from the passage 10 for the purpose of cutting electricity for supplying a consuming unit 7 which can be connected via a feed line 46. The conductor rail 2 comprises an insulating profile 20 and current conductors 24,27 which are accommodated in wire channels 22,25 and can be tapped via access points 23,26 at least more or less over the entire axial extent of the current conductors 24,27 and in at least largely uninterrupted manner. The conductor rail 2 is arranged in a current-conducting groove 15 which extends from the passage 10.

The insulating profile 20 of the conductor rail 2 has outer contours 21 which fit into complementary inner contours on the current-conducting groove 15. The current-conducting groove 15 is arranged, remote from the entry point 100, in the depth of the passage 10 and, in principle, perpendicularly to the latter. The access points 23,26 open, in principle, perpendicularly to the passage 10. The insulating profile 20 has an M-shaped cross section in principle. The two access points 23,26 are each located at the bottom within the side legs of the M-shaped cross section. The wire channels 22,25 with the current conductors 24,27 provided therein are each located at the top within the side legs, in the profile tips. The current conductors 24,27 can be tapped by an adapter 4 which can be pushed into the passage 10.

The end of the passage 10 is defined by a base plate 11 which has a top extension 110 extending upward and a bottom extension 113 extending downward, beyond the region of the incoming passage 10. Adjacent to the base plate 11, a hook groove 16 extends upward, and an arresting groove 17 extends downward, out of the passage 10.

The passage 10 is bounded at the top by a top strut 13 and at the bottom by a bottom strut 12. The passage 10 has:

a) at the top, a slope which slopes upward in the direction of the entry point 110 and thus forms a top clearance 101, b) at the bottom, an inclination which is inclined downward in the direction of the base plate 11 and thus forms a bottom clearance 102, c) in the bottom strut 12, in the vicinity of the entry point 100, a strip groove 18 for accommodating a non-slip and damping, preferably elastic extruded profile 180; and d) at the end of the passage 10, an axially accessible raised molding 103, extending along the profiled rail 1, for tapping the ground contact 44 of the adapter 4.

The profile rail 1, furthermore, has:

a) a supporting strut 14 which extends from the bottom strut 12, opens out into the bottom extension 113 and encloses a cavity 114 with the bottom strut 12;

b) on the top strut 13, a downwardly extending tongue 130 with a tongue groove 131 located alongside it;

c) on the bottom strut 12, a downwardly extending tongue 120 with a tongue groove 121 located alongside it;

d) in each case one screw-connection channel 115,111 in the region of a supporting strut 14 extends from the bottom strut 12 and in the region where the top strut 13 opens out into the base plate 11;

e) on the top extension 110, a notched line 112, preferably on both sides, has a marking;

f) the tongue strips 120,130 are intended for being accommodated in tongue grooves 920 which are present in the edges of carrying structure 9;

g) the notched lines 112 serve as an orientation means for screw holes which may optionally be provided, and can be utilized in order for the construction comprising the carrying structure 9 with one or more profiled rails 1 introduced to be fastened directly or indirectly on a part of a building.

The power supply 3 is formed by:

a) a cutout 19 on the profiled rail 1, into which a connection terminal 30 is inserted;

b) a plug coupling 31 comprising a bushing 33, which is positioned in the cutout 19 alongside the connection terminal 30, and a plug 32, which can be coupled to the bushing 33 from the outside and to which the current-supplying feed line 320 is connected; and c) a ground terminal 34 on the profiled rail 1.

The carrier 8,6 has, when in the form of a carrying arm 8, at the plug-in end 801 of the bar part 80, at least one tongue element 81 which can be plugged into the passage 10 of the profiled rail 1 and has a bottom tapered portion 83 and an upwardly directed hook 82 which is intended for engaging in the hook groove 16. As an alternative, the carrier 6 is in the form of a shelf of which the rear edge 60 can be plugged into the passage 10 of the profiled rail 1.

The adapter 4 can be pushed separately into the passage 10 for power take-off or, inserted into an aperture 61 of a shelf 6, can be pushed into the passage 10 together with the shelf 6. The adapter 4 comprises:

a) a rotatable pin 410;

b) on the input side:

ba) contact lugs 42,43 which can be pivoted on the rotatable pin 410 and are intended for power take-off from the current conductors 24,27; and bb) a tap 44 for the grounding conductor; and c) on the output side:

ca) line connections 420,430 and a ground-contact connection 440, which are connected to a feed line 46 to a consuming unit 7.

The adapter 4 also comprises:

a) a housing 40 with a bottom plate 400, a cover 401, an output connector 402 and an optional plate groove 403 in the housing 40 for insertion into the aperture 61 of a shelf 6, the output connector 402 merging into a conduit 460 for further cable routing to the consuming unit 7;

b) a rotary knob 41, which is accessible to the user and is connected to the pin 410;

c) a pin bearing 411 in the housing 40, and an inhibiter 412 acting on the pin 410; and d) a catch 45, which is seated on the pin 410 and, in the connected state, when the contact lugs 42,43 butt against the current conductors 24,27 engages at least in one of the grooves 16,17; it being the case that e) the catch 45, in the disconnected state, is disengaged, with the result that the adapter 4 can be pushed into the passage 10 or drawn out of the passage 10.

The invention claimed is:

1. A profiled rail assembly for a suspension device to be fastened horizontally on a carrying structure (9) erected in a substantially vertical plane, the profiled rail assembly comprising:

a profiled rail (1) including:

a passage (10) having an end defined by a base plate (11) having a top extension (110) extending upward and a bottom extension (113) extending downward beyond the region of the passage (10), a front entry point (100), the passage (10) extending into the profiled rail (1) substantially horizontally from the front entry point (100), a top strut (13) at the top of the passage (10) and a bottom strut (12) at the bottom of the passage (10), a top clearance (101) which slopes upward in the direction of the entry point (100) at the top of the passage (10), a bottom clearance (102) which is inclined downward in the direction of the base plate (11) at the bottom of the profiled rail (1), a strip groove (18) formed in the bottom strut (12), in the vicinity of the entry point (100), and a non-slip and damping, preferably elastic, extruded profile (180) arranged within the strip groove (18), and at the end of the passage (10), an axially accessible raised molding (103), extending along the profiled rail (1) to engage the adapter (4), a hook groove (16) extending upwardly from the passage (10) and adjacent the base plate (11);

an arresting groove (17) extending downwardly, out of the passage (10);

a carrier (6,8) sized and shaped so as to engage, via the entry point (100), the passage (10) of the profiled rail (1) and whereby articles can be suspended or set down on the carrier (6,8);

a conductor rail (2) arranged within the passage (10) and including a plurality of current conductors (24,27);

a power supply line (3) sized and shaped so as to convey electricity to the conductor rail (2);

a feed line (46) connecting the current conductors (24,27) to a consuming unit (7) to convey electricity to the consuming unit (7); and an adapter (4) sized and shaped so as to insertably engage the passage (10) and to operatively engage the current conductors (24,27) in the passage (10).

2. The profiled rail assembly as claimed in claim 1, wherein the profiled rail (1) further includes:

a) a supporting strut (14) which extends from the bottom strut (12), to the bottom extension (113) and defines a cavity (114) with the bottom strut (12);

b) on the top strut (13), a downwardly extending tongue (130) with a tongue groove (131) located alongside the extending tongue (130);

c) a downwardly extending tongue (120) and an adjacent tongue groove (121) arranged on the bottom strut (12);

d) a first screw-connection channel (111) adjacent the junction of the top strut (13) and the base plate (11);

e) a second screw-connection channel (115) adjacent the junction of the strut (14) and the bottom strut (12);

f) at least one notch (112) in the top extension (110), wherein the tongues (120,130) are sized and shape to engage tongue grooves (920) formed in the carrying structure (9); and g) the notched lines (112) serve as an orientation means for screw holes in the construction of the carrying structure (9) with at least one profiled rail (1) inserted to be fastened on a part of a building.

3. The profiled rail assembly as claimed in claim 2, wherein the notch (112) is on both sides of the top extension (110).

4. A profiled rail assembly for a suspension device to be fastened horizontally on a carrying structure (9) erected in a substantially vertical plane, the profiled rail assembly comprising:

a profiled rail (1) having a passage (10) and a front entry point (100), the passage (10) extending into the profiled rail (1) substantially horizontally from the front entry point (100);

a carrier (6,8) sized and shaped so as to engage, via the entry point (100), the passage (10) of the profiled rail (1) and whereby articles can be suspended or set down on the carrier (6,8);

a hook groove (16) extending upwardly from the passage (10);

a conductor rail (2) arranged within the passage (10) and including a plurality of current conductors (24,27);

a power supply line (3) sized and shaped so as to convey electricity to the conductor rail (2), and including:

a cutout (19) on the profiled rail (1), into which a connection terminal (30) is inserted;

a plug coupling (31) comprising a bushing (33), which is positioned in the cutout (19) alongside the connection terminal (30), and a plug (32), which can be coupled to the bushing (33) from the outside and to which the current-supplying feed line (320) is connected; and a ground terminal (34) on the profiled rail (1);

a feed line (46) connecting the current conductors (24,27) to a consuming unit (7) to convey electricity to the consuming unit (7); and an adapter (4) sized and shaped so as to insertably engage the passage (10) and to operatively engage the current conductors (24,27) in the passage (10).

5. A profiled rail assembly for a suspension device to be fastened horizontally on a carrying structure (9) erected in a substantially vertical plane, the profiled rail assembly comprising:

a profiled rail (1) having a passage (10) and a front entry point (100), the passage (10) extending into the profiled rail (1) substantially horizontally from the front entry point (100);

a shelf (6) sized and shaped so as to engage, via the entry point (100), the passage (10) of the profiled rail (1) and whereby articles can be suspended or set down on the shelf (6);

a hook groove (16) extending upwardly from the passage (10);

a conductor rail (2) arranged within the passage (10) and including a plurality of current conductors (24,27);

a power supply line (3) sized and shaped so as to convey electricity to the conductor rail (2);

a feed line (46) connecting the current conductors (24,27) to a consuming unit (7) to convey electricity to the consuming unit (7); and an adapter (4) sized and shaped so as to insertably engage the passage (10) and to operatively engage the current conductors (24,27) in the passage (10), the shelf (6) having a rear edge (60) sized and shaped so as to engage the passage (10) of the profiled rail (1), and the shelf (6) including an aperture (61) sized and shaped so as to receive the adapter (4), the adapter (4) being sized and shaped so as to be inserted into the passage (10) together with the shelf (6).

6. The profiled rail assembly as claimed in claim 1, wherein the carrier is a carrying arm (8) which includes a bar part (80) with a plug-in end (801), and at least one tongue element (81) at the plug-in end (801) which can be plugged into the passage (10) of the profiled rail (1); and the plug-in end (801) is provided with an upwardly directed hook (82) which is sized and shaped so as to engage in the hook groove (16).

7. The profiled rail assembly as claimed in claim 6, wherein the plug-in end (801) of the carrying arm (8) has a tapered bottom portion (83).

8. A profiled rail assembly for a suspension device to be fastened horizontally on a carrying structure (9) erected in a substantially vertical plane, the profiled rail assembly comprising:

a profiled rail (1) having a passage (10) and a front entry point (100), the passage (10) extending into the profiled rail (1) substantially horizontally from the front entry point (100);

a carrier (6,8) sized and shaped so as to engage, via the entry point (100), the passage (10) of the profiled rail (1) and whereby articles can be suspended or set down on the carrier (6,8);

a hook groove (16) extending upwardly from the passage (10);

a conductor rail (2) arranged within the passage (10) and including a plurality of current conductors (24,27);

a power supply line (3) sized and shaped so as to convey electricity to the conductor rail (2);

a feed line (46) connecting the current conductors (24,27) to a consuming unit (7) to convey electricity to the consuming unit (7); and an adapter (4) sized and shaped so as to insertably engage the passage (10) and to operatively engage the current conductors (24,27) in the passage (10), the adapter (4) including:

a) a rotatable pin (410);

b) on the input side:

ba) contact lugs (42,43) which can be pivoted on the rotatable pin (410) and are intended for power take-off from the current conductors (24,27); and bb) a tap (44) for the grounding conductor;

c) on the output side:

ca) line connections (420,430) and a ground-contact connection (440), which are connected to the feed line (46) to the consuming unit (7), d) a housing (40) with a bottom plate (400), a cover (401), an output connector (402) and an optional plate groove (403) in the housing (40) for insertion into an aperture (61) of a shelf (6), the output connector (402) merging into a conduit (460) for further cable routing to the consuming unit (7);

e) a rotary knob (41), which is accessible to the user and is connected to the pin (410);

f) a pin bearing (411) in the housing (40), and an inhibiter (412) acting on the pin (410); and g) a catch (45), which is seated on the pin (410) and, in the connected state, when the contact lugs (42,43) butt against the current conductors (24,27) engages at least in one of the grooves (16,17); such that h) the catch (45), in the disconnected state, is disengaged, with the result that the adapter (4) can be pushed into the passage (10) and drawn out of the passage (10).

* * * * *

UNITED STATES PATENT AND TRADEMARK OFFICE

CERTIFICATE OF CORRECTION

PATENT NO. : 7,122,744 B2
APPLICATION NO. : 10/505389
DATED : October 17, 2006
INVENTOR(S) : Herbert Walter and Manfred Uecker It is certified that error appears in the above-identified patent and that said Letters Patent is hereby corrected as shown below:

Column 3, line 59, delete the sentence "In the drawings" and insert --For a more complete understanding of the present invention, reference is made to the following detailed description of the exemplary embodiments considered in conjunction with the accompanying drawings, in which--;

Column 4, line 27, "IA" should be deleted and --1A-- should be inserted therefor;

Signed and Sealed this

Sixth Day of October, 2009

David J. Kappos

David J. Kappos
*Director of the United States Patent and Trademark Office*